US009530271B2

(12) United States Patent
Moribayashi et al.

(10) Patent No.: US 9,530,271 B2
(45) Date of Patent: Dec. 27, 2016

(54) BANKNOTE HANDLING APPARATUS AND BANKNOTE HANDLING METHOD

(75) Inventors: Shigenori Moribayashi, Saitama (JP); Yoshihiko Miyama, Hunabashi (JP); Yasushi Ikeda, Kawasaki (JP)

(73) Assignee: Glory Ltd., Himeji-shi, Hyogo-ken (JP)

( * ) Notice: Subject to any disclaimer, the term of this patent is extended or adjusted under 35 U.S.C. 154(b) by 0 days.

(21) Appl. No.: 14/415,613

(22) PCT Filed: Jul. 19, 2012

(86) PCT No.: PCT/JP2012/068310

§ 371 (c)(1),
(2), (4) Date: Mar. 26, 2015

(87) PCT Pub. No.: WO2014/013585

PCT Pub. Date: Jan. 23, 2014

(65) Prior Publication Data

US 2015/0221159 A1 Aug. 6, 2015

(51) Int. Cl.

| | |
|---|---|
| ***G07D 11/00*** | (2006.01) |
| ***G07D 7/00*** | (2016.01) |
| ***G07D 7/20*** | (2016.01) |

(52) U.S. Cl.

CPC ..... *G07D 11/0084* (2013.01); *G07D 7/20* (2013.01); *G07D 11/0051* (2013.01); *G07D 11/0078* (2013.01)

(58) Field of Classification Search

CPC .. G07D 7/00; G07D 11/0036; G07D 11/0051; G07D 11/0084

(Continued)

(56) References Cited

U.S. PATENT DOCUMENTS 6,493,461 B1 * 12/2002 Mennie ..... G07D 7/162 382/135
7,934,601 B2 * 5/2011 Matsuura ..... G07D 7/2058 194/206

(Continued)

FOREIGN PATENT DOCUMENTS

JP 2003-178348 A 6/2003
JP 2007-199927 A 8/2007

(Continued)

OTHER PUBLICATIONS

European Search Report (Application No. 12881192.4—PCT/JP2012/068310) (9 pages—dated Jul. 3, 2016).

*Primary Examiner* — Mark Beauchaine
(74) *Attorney, Agent, or Firm* — Renner, Kenner, Greive, Bobak Taylor & Weber

(57) ABSTRACT

The object of the present invention is to provide a banknote handling apparatus and a banknote handling method capable of dealing currencies of a number of nations, and handling them at a predetermined speed or more. A banknote handling apparatus according to one embodiment of the present invention includes: a reception unit configured to take in, one by one, a banknote put thereinto; a transport unit configured to transport the taken-in banknote; a memory unit storing a plurality of banknote recognition data elements corresponding to currencies of a plurality of nations; a selection unit configured to select and group a plurality of the banknote recognition data elements stored in the memory unit, such that a predetermined criterion is met; and a recognition unit disposed on the transport unit, and configured to recognize the banknote taken in by the reception unit, based on the grouped banknote recognition data elements.

19 Claims, 8 Drawing Sheets

| CURRENCY | US DOLLAR | YEN | EURO | YUAN | POUND | SWISS FRANC |
|---|---|---|---|---|---|---|
| NUMBER OF DENOMINATIONS | 7 | 4 | 7 | 6 | 4 | 6 |
| CURRENCY | CANADIAN DOLLAR | AUSTRALIAN DOLLAR | HONG KONG DOLLAR (1) | HONG KONG DOLLAR (2) | HONG KONG DOLLAR (3) | NEW TAIWANESE DOLLAR |
| NUMBER OF DENOMINATIONS | 5 | 5 | 6 | 6 | 6 | 5 |
| CURRENCY | NZ DOLLAR | SINGAPOREAN DOLLAR | REAL | RAND | RUBLE | BAHT |
| NUMBER OF DENOMINATIONS | 5 | 7 | 7 | 5 | 6 | 6 |
| CURRENCY | DANISH KRONE | SWEDISH KRONA | NORWEGIAN KRONE | KOREAN WON | INDIAN RUPEE | TURKISH LIRA |
| NUMBER OF DENOMINATIONS | 5 | 5 | 5 | 4 | 7 | 6 |

(58) Field of Classification Search
USPC ..... 194/206, 217
See application file for complete search history.

(56) References Cited

U.S. PATENT DOCUMENTS

| | | | |
|---|---|---|---|
| 2002/0126886 | A1 | 9/2002 | Jones et al. |
| 2007/0295812 | A1 | 12/2007 | Mazowiesky et al. |

FOREIGN PATENT DOCUMENTS

| | | | |
|---|---|---|---|
| JP | 2008-27356 | A | 2/2008 |
| WO | WO 01/61655 | A1 | 8/2001 |
| WO | WO 2006/123439 | A1 | 11/2006 |
| WO | WO 2010/097935 | A1 | 9/2010 |

* cited by examiner

DESIGNATE CURRENCY

40

| CURRENCY | US DOLLAR | YEN | EURO | YUAN | POUND | SWISS FRANC |
|---|---|---|---|---|---|---|
| NUMBER OF DENOMINATIONS | 7 | 4 | 7 | 6 | 4 | 6 |
| CURRENCY | CANADIAN DOLLAR | AUSTRALIAN DOLLAR | HONG KONG DOLLAR (1) | HONG KONG DOLLAR (2) | HONG KONG DOLLAR (3) | NEW TAIWANESE DOLLAR |
| NUMBER OF DENOMINATIONS | 5 | 5 | 6 | 6 | 6 | 5 |
| CURRENCY | NZ DOLLAR | SINGAPOREAN DOLLAR | REAL | RAND | RUBLE | BAHT |
| NUMBER OF DENOMINATIONS | 5 | 7 | 7 | 5 | 6 | 6 |
| CURRENCY | DANISH KRONE | SWEDISH KRONA | NORWEGIAN KRONE | KOREAN WON | INDIAN RUPEE | TURKISH LIRA |
| NUMBER OF DENOMINATIONS | 5 | 5 | 5 | 4 | 7 | 6 |

41

UPPER LIMIT OF DENOMINATION NUMBER :64
NUMBER OF ALREADY SELECTED DENOMINATIONS :14
ALLOWABLE NUMBER OF DENOMINATIONS :50

42

ENTER

FIG. 6

BANKNOTE HANDLING APPARATUS AND BANKNOTE HANDLING METHOD

TECHNICAL FIELD

The present invention relates to a banknote handling apparatus and a banknote handling method capable of counting banknotes of a plurality of nations.

BACKGROUND ART

In order to cope with a case in which users desire to handle money of different nations, there has conventionally been known a banknote handling apparatus that downloads only money recognition data elements of an intended nation (see, for example, Patent Document 1). When the intended nation is changed into another nation in such a banknote handling apparatus, new money recognition data elements has to be downloaded. In addition, when money recognition data elements of a target intended nation are not stored in an external storage medium, it is necessary to prepare a new external storage medium.

On the other hand, in accordance with the semiconductor technique progress, a storage device becomes smaller in size and grows in capacity. Thus, even a small banknote handling apparatus can include a high-capacity storage device. In order to respond requests of a lot of users, it can be considered that the banknote handling apparatus is made to store a great number of money recognition data elements by using such a storage device. However, in this case, money has to be compared with the great number of money recognition data elements, whereby a processing speed lowers.

Patent Document 1: WO2010/097935

SUMMARY OF THE INVENTION

The present invention has been made in view of the above circumstances. The object of the present invention is to provide a banknote handling apparatus and a banknote handling method capable of dealing currencies of a number of nations, and handling them at a predetermined speed or more.

A banknote handling apparatus according to an embodiment of the present invention includes: a reception unit configured to take in, one by one, a banknote put thereinto; a transport unit configured to transport the taken-in banknote; a memory unit storing a plurality of banknote recognition data elements corresponding to currencies of a plurality of nations; a selection unit configured to select and group a plurality of the banknote recognition data elements stored in the memory unit, such that a predetermined criterion is met; and a recognition unit disposed on the transport unit, and configured to recognize the banknote taken in by the reception unit, based on the grouped banknote recognition data elements.

In the banknote handling apparatus according to the embodiment of the present invention, each banknote recognition data element includes a plurality of denomination recognition data elements, and the predetermined criterion is a criterion related to the number of denomination recognition data elements included in one group.

In the banknote handling apparatus according to the embodiment of the present invention, the number of denomination recognition data elements is weighted by a weighting coefficient value set for each currency.

In the banknote handling apparatus according to the embodiment of the present invention, the predetermined criterion is a criterion related to a total data amount of the banknote recognition data elements included in one group.

In the banknote handling apparatus according to the embodiment of the present invention, the predetermined criterion is a criterion related to a time period required for recognizing a single banknote, when the recognition unit recognizes a banknote based on the grouped banknote recognition data elements.

The banknote handling apparatus according to the embodiment of the present invention further includes a verification unit configured to allow, upon receipt of a verification instruction, the selection unit to select a banknote recognition data element of a currency subject to the verification instruction.

In the banknote handling apparatus according to the embodiment of the present invention, the memory unit stores a banknote recognition data element corresponding to new version of banknotes, and a banknote recognition data element corresponding to old version of banknotes.

The banknote handling apparatus according to the embodiment of the present invention further includes a display unit, wherein the recognition unit is configured to recognize and count a banknote, and the display unit is configured to display a count result of the recognition unit for each currency.

A banknote handling apparatus according to another embodiment of the present invention includes: a reception unit configured to take in, one by one, a banknote put thereinto; a transport unit configured to transport the taken-in banknote; a memory unit storing a plurality of groups including a plurality of banknote recognition data elements corresponding to currencies of a plurality of nations; a selection unit configured to select at least any one of the plurality of groups stored in the memory unit; and a recognition unit disposed on the transport unit, and configured to recognize the banknote taken in by the reception unit, based on the banknote recognition data elements included in the group selected by the selection unit.

In the banknote handling apparatus according to the one embodiment of the present invention, each banknote recognition data element includes a plurality of denomination recognition data elements, and the groups are set such that the number of denomination recognition data elements included in each group meets a predetermined criterion.

In the banknote handling apparatus according to the one embodiment of the present invention, the number of denomination recognition data elements is weighted by a weighting coefficient value set for each currency.

In the banknote handling apparatus according to the one embodiment of the present invention, the groups are set such that a total data amount of the banknote recognition data elements included in each group meets a predetermined criterion.

In the banknote handling apparatus according to the one embodiment of the present invention, the groups are set such that a time period required for the recognition unit to recognize a single banknote, based on the banknote recognition data elements included in one group selected by the selection unit, meets a predetermined criterion.

In the banknote handling apparatus according to the one embodiment of the present invention, each banknote recognition data element includes a plurality of denomination recognition data elements, and the selection unit is configured to select any one of the plurality of groups stored in the memory unit, and add, to the selected group, a banknote recognition data element not included in the selected group, such that the number of denomination recognition data elements included in the selected group does not exceed a predetermined value.

The banknote handling apparatus according to the one embodiment of the present invention further includes a verification unit configured to allow, upon receipt of a verification instruction, the selection unit to select a banknote recognition data element of a currency subject to the verification instruction.

In the banknote handling apparatus according to the one embodiment of the present invention, the memory unit stores a banknote recognition data element corresponding to new version of banknotes, and a banknote recognition data element corresponding to old version of banknotes.

The banknote handling apparatus according to the one embodiment of the present invention further includes a display unit, wherein the recognition unit is configured to recognize and count a banknote, and the display unit is configured to display a count result of the recognition unit for each currency.

A banknote handling method according to an embodiment of the present invention includes: selecting and grouping a plurality of banknote recognition data elements from a memory unit storing a plurality of banknote recognition data elements corresponding to currencies of a plurality of nations, such that a predetermined criterion is met; taking in, by a reception unit, a banknote put thereinto, one by one; and recognizing, by a recognition unit, the banknote taken in by the reception unit, based on the grouped banknote recognition data elements.

A banknote handling method according to another embodiment of the present invention includes: selecting at least one group from a memory unit storing a plurality of groups including a plurality of banknote recognition data elements corresponding to currencies of a plurality of nations; taking in, by a reception unit, a banknote put thereinto, one by one; and recognizing, by a recognition unit, the banknote taken in by the reception unit, based on the banknote recognition data elements included in the selected group.

According to the present invention, currencies of a plurality of nations can be dealt and handled at a predetermined speed or more.

BRIEF DESCRIPTION OF THE DRAWINGS

FIG. 6 is a view showing an example of the currency designation screen.

MODES FOR CARRYING OUT THE INVENTION

Embodiments of the present invention will be described herebelow with reference to the drawings.

First Embodiment

Figure 1:
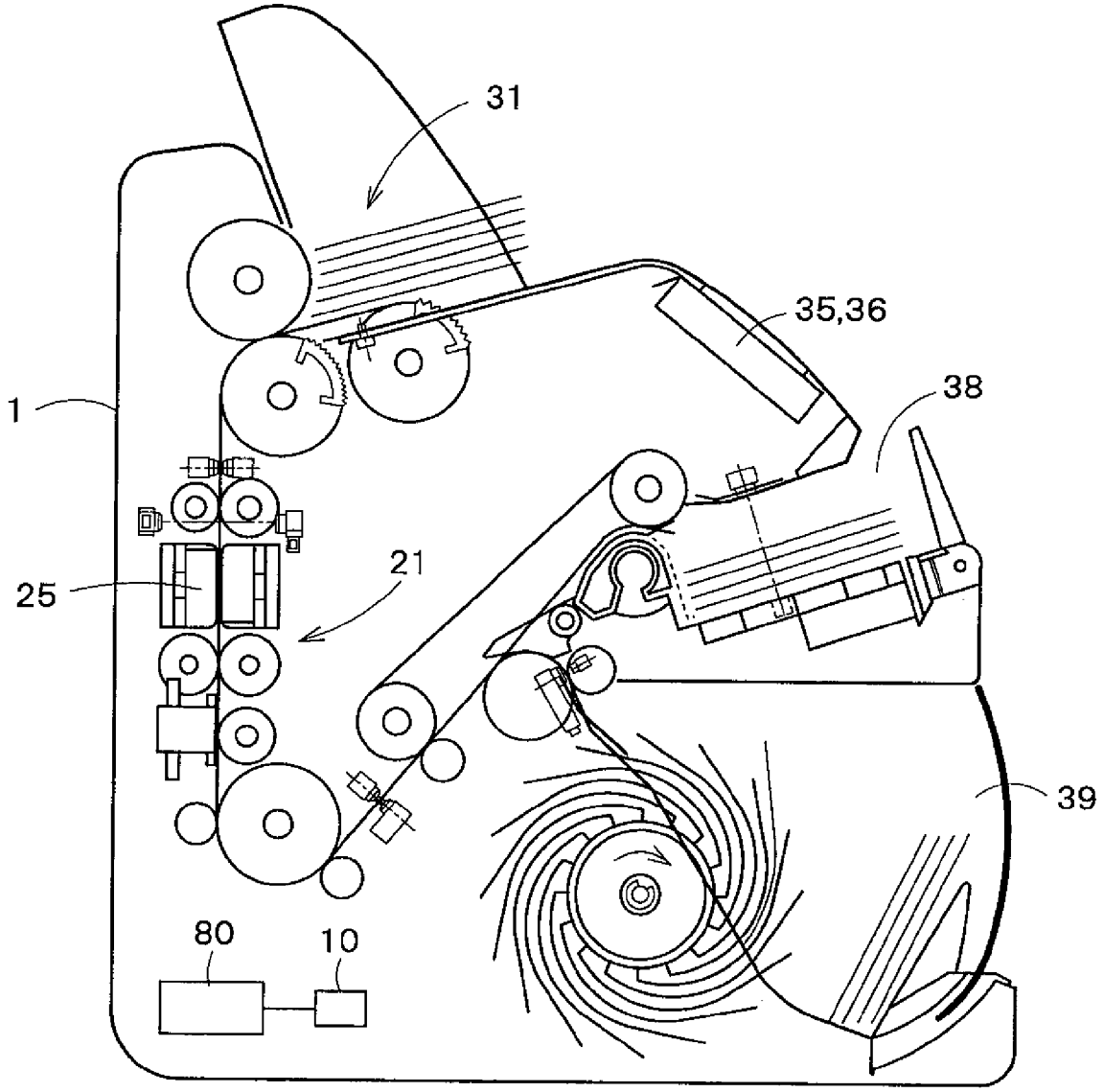
FIG. 1 is a sectional view of a banknote handling apparatus according to a first embodiment.
Figure 2:
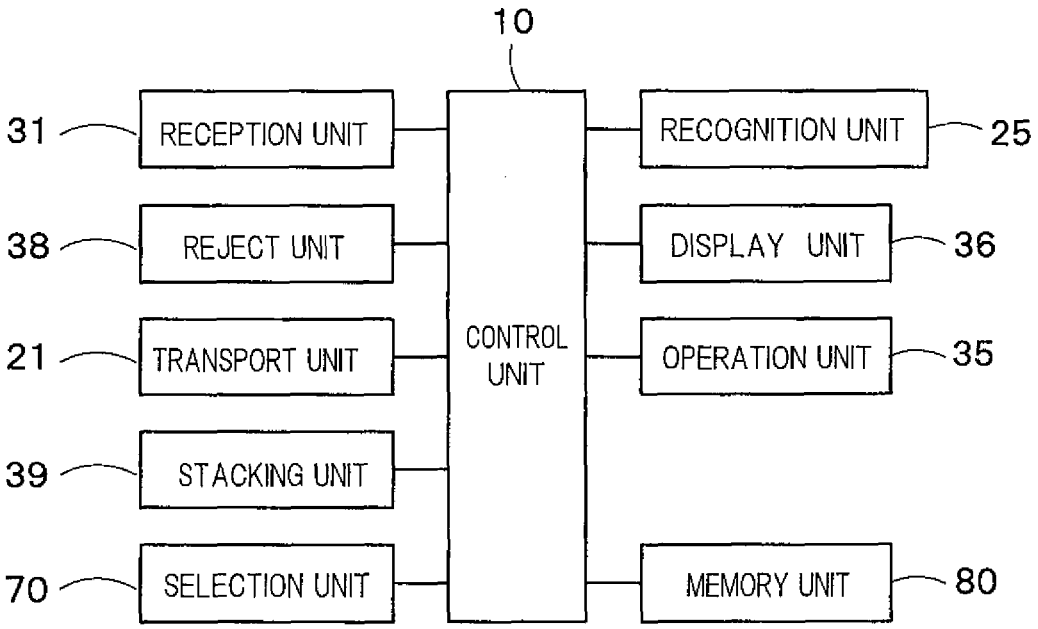
FIG. 2 is a block structural diagram of the banknote handling apparatus according to the first embodiment.

FIG. 1 is a sectional view of a banknote handling apparatus according to a first embodiment, and FIG. 2 is a block structural diagram of the banknote handling apparatus.

As shown in FIGS. 1 and 2, the banknote handling apparatus includes: a housing 1; a reception unit 31 configured to take in, one by one, a banknote put thereinto; a transport unit 21 configured to transport in the housing 1 the banknote taken in by the reception unit 31; a recognition unit 25 configured to recognize the banknote transported by the transport unit 21; a reject unit 38 configured to stack an unrecognizable banknote, a transport abnormal banknote, a counterfeit banknote and so on; a stacking unit 39 configured to stack the banknote recognized by the recognition unit 25; a display unit 36 having a display screen; and a memory unit 80 storing a plurality of money recognition data elements corresponding to currencies of a plurality of nations. Each money recognition data element is used by the recognition unit 25 for recognizing a banknote, which will be described in detail later.

The abnormal transport includes a state where a banknote is transported askew (skewed state), a state where a plurality of banknotes are overlappingly transported (overlapped state), a state where banknotes are transported without a predetermined interval therebetween (chained state) and so on.

In addition, the banknote handling apparatus includes an operation unit 35 configured to receive an operation from a user, and a selection unit 70 configured to select and group a plurality of banknote recognition data elements stored in the memory unit 80, based on an operation received by the operation unit 35 and a predetermined criterion described below.

Further, the banknote handling apparatus includes a control unit 10 configured to control the respective units.

Figure 3:
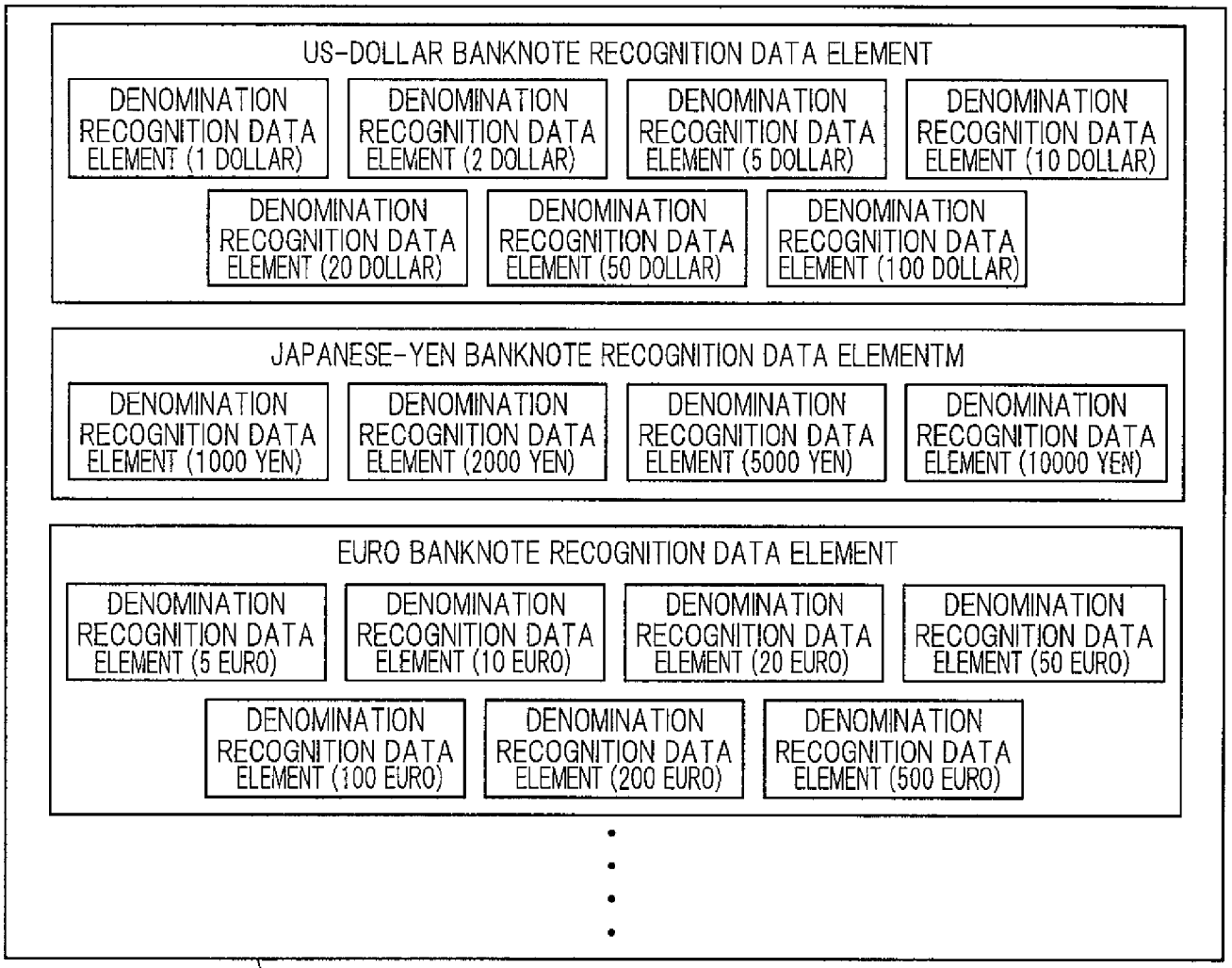
FIG. 3 is a view showing an example of banknote recognition data elements.

The banknote recognition data elements are described with reference to FIG. 3. As shown in FIG. 3, the memory unit 80 stores banknote recognition data elements corresponding to currencies of a number of nations, such as US dollar, Japanese yen, Euro and so on. The "nation" includes the EU and the like.

One banknote recognition data element includes denomination recognition data elements corresponding to respective denominations. For example, the banknote recognition data element of US dollar includes denomination recognition data elements corresponding to seven denominations of 1 dollar, 2 dollar, 5 dollar, 10 dollar, 20 dollar 50 dollar and 100 dollar. In addition, the banknote recognition data element of Japanese yen includes denomination recognition data elements corresponding to four denominations of 1000 yen, 2000 yen, 5000 yen and 10000 yen.

Next, grouping of banknote recognition data elements by the selection unit 70 is described. In this embodiment, the selection unit 70 groups banknote recognition data elements of a plurality of currencies, based on a predetermined criterion. Herein, the predetermined criterion is an upper limit of the number of denomination recognition data elements that can be included in one group. Information about the predetermined criterion is stored in the memory unit 80, for example.

An example of grouping of banknote recognition data elements is described. As shown in the below Table 1, the memory unit 80 stores 24 banknote recognition data elements such as US dollar, yen, euro, yuan, pound, Swiss franc, etc. An upper limit of the number of denomination recognition data elements that can be included in one group is 64. The number of denominations in Table 1 corresponds to the number of denomination recognition data elements. As to Hong Kong dollar, banknotes having different designs are issued by three banks, there are three banknote recognition data elements.

TABLE 1

| | Currency | | | | | |
|---|---|---|---|---|---|---|
| | US dollar | Yen | Euro | Yuan | Pound | Swiss franc |
| Number of Denominations | 7 | 4 | 7 | 6 | 4 | 6 |
| | Currency | | | | | |
| | Canadian dollar | Australian dollar | Hong Kong dollar (1) | Hong Kong dollar (2) | Hong Kong dollar (3) | New Taiwanese dollar |
| Number of Denominations | 5 | 5 | 6 | 6 | 6 | 5 |
| | Currency | | | | | |
| | NZ dollar | Singaporean dollar | Real | Rand | Ruble | Baht |
| Number of Denominations | 5 | 7 | 7 | 5 | 6 | 6 |
| | Currency | | | | | |
| | Danish krone | Swedish krona | Norwegian krone | Korean won | Indian rupee | Turkish lira |
| Number of Denominations | 5 | 5 | 5 | 4 | 7 | 6 |

For example, when banknote recognition data elements of US dollar, yen, euro, yuan, pound, Swiss franc, Canadian dollar, Australian dollar, NZ dollar, Singaporean dollar and ruble are selected, the total of the denomination recognition data elements is 62 (=7+4+7+6+4+6+5+5+5+7+6). Since the upper limit is 64, these banknote recognition data elements can be grouped. In this case, it is impossible to select any additional banknote recognition data element.

The recognition unit 25 recognizes banknotes by using the banknote recognition data elements that are grouped as described above. To be specific, the recognition unit 25 obtains a feature (size, image) of a banknote transported by the transport unit 21, and compares the feature with the respective denomination recognition data elements included in the grouped banknote recognition data elements. When the obtained feature of the banknote conforms with one of the denomination recognition data elements, the recognition unit 25 can recognize a currency, a denomination and so on of the transported banknote. On the other hand, when none of the denomination recognition data elements included in the grouped banknote recognition data elements conforms with the obtained feature, the recognition unit 25 cannot recognize the banknote.

Figure 4:
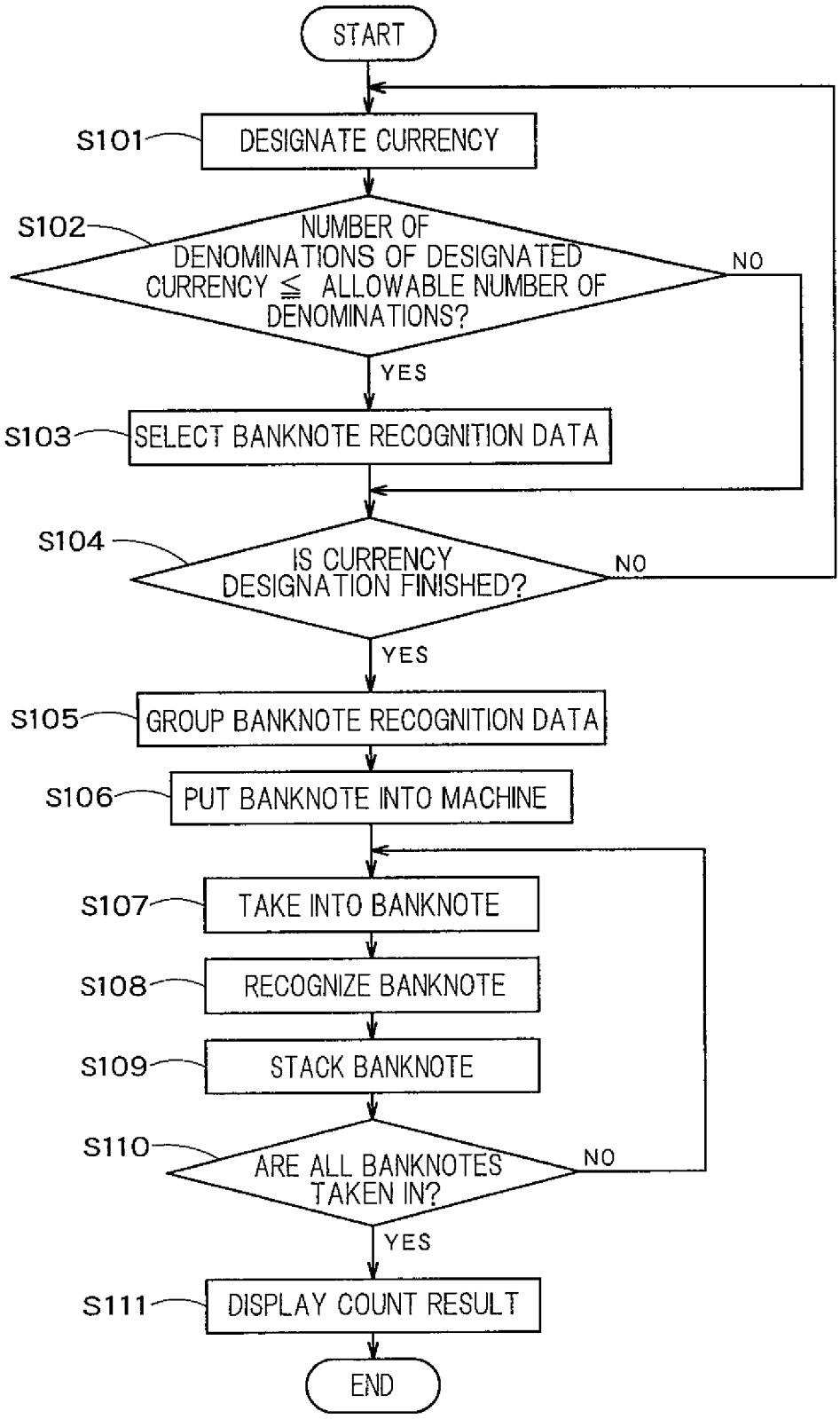
FIG. 4 is a flowchart explaining a banknote handling method according to the first embodiment.

Next, the banknote handling method is explained with reference to the flowchart shown in FIG. 4.

(Step S101)

Figure 5:
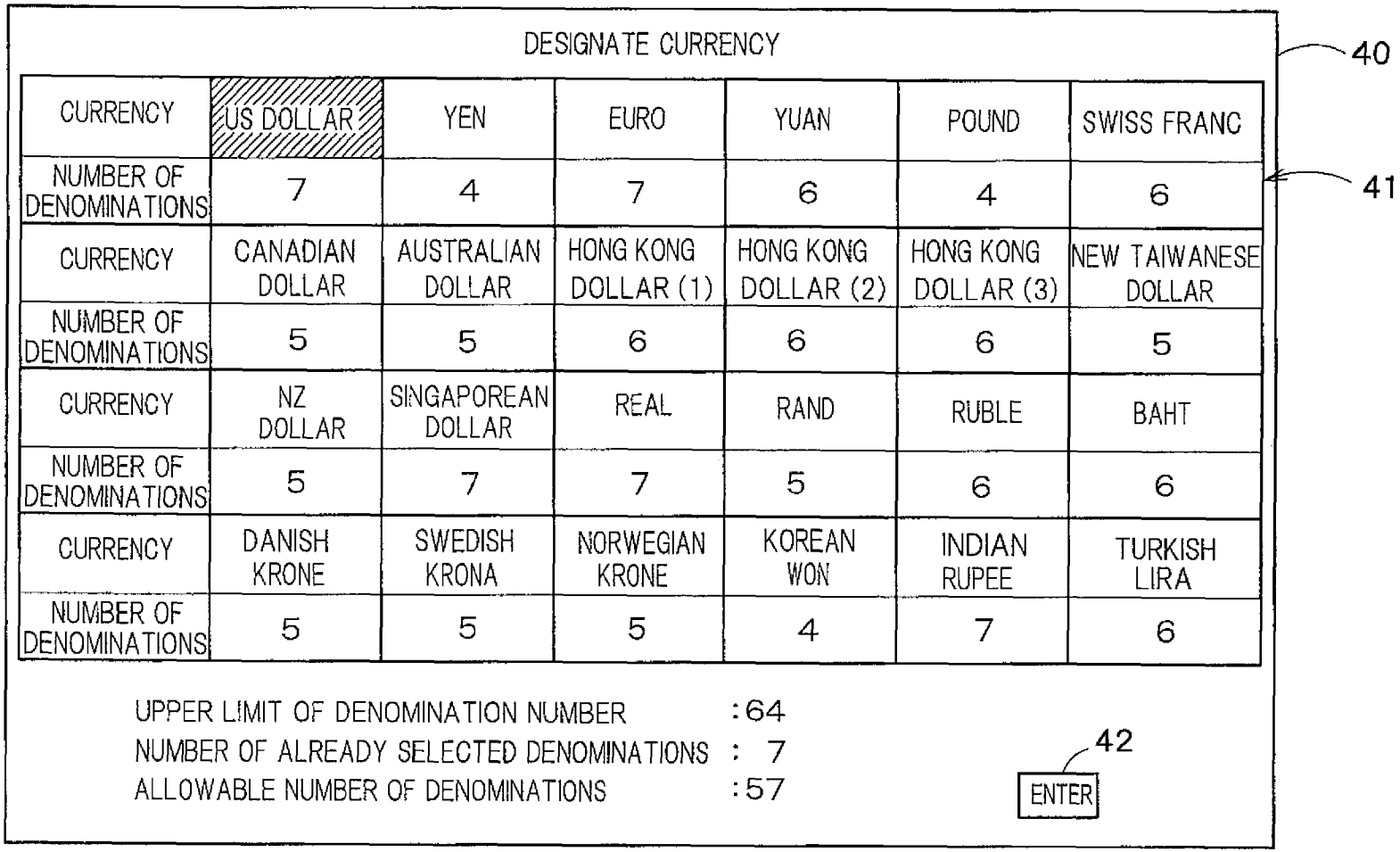
FIG. 5 is a view showing an example of a currency designation screen.

A user designates a currency to be recognized. For example, as shown in FIG. 5, the operation unit 35 and the display unit 36 are constituted by a touch panel 40. The touch panel 40 displays a list of currencies whose banknote recognition data elements are stored in the memory unit 80. The user touches a currency designation key 41 on the touch panel 40 so as to designate a currency.

In addition, as shown in FIG. 5, the touch panel 40 (display unit 36) displays, as a predetermined criterion, the upper limit of the number of denomination recognition data elements that can be included in one group, the total number of denomination recognition data elements included in the already selected banknote recognition data elements, and the allowable number of denominations obtained by deducting the total number from the upper limit. In the example shown in FIG. 5, the banknote recognition data element of US dollar has been already selected.

(Step S102)

When the number of denominations of the currency designated in the step S101 is not more than the allowable number of denominations, the program proceeds to a step S103. On the other hand, when the number of denominations is larger than the allowable number of denominations, the program proceeds to a step S104.

(Step S103)

The selection unit 70 selects the banknote recognition data element corresponding to the currency that has been designated in the step S101. Thus, as shown in FIG. 6, the total number and the allowable number of denominations, which are displayed on the touch panel 40 (display unit 36), change. In addition, a color of the currency designation key 41 of the already selected currency changes.

(Step S104)

After the currency designation has been finished, the user presses an enter key 42 on the touch panel 40, and the program proceeds to a step S105. When the currency designation is continued, the program returns to the step S101.

(Step S105)

The selection unit 70 groups the already selected banknote recognition data elements. The total number of denomination recognition data elements included in the plurality of grouped banknote recognition data elements is not more than the predetermined upper limit. The grouped banknote recognition data elements are stored in the memory unit 80 or another memory unit.

(Step S106)

The user puts banknotes of mixed currencies and denominations into the reception unit 31 of the banknote handling apparatus.

(Step S107)

The reception unit 31 takes into the banknotes one by one.

(Step S108)

The recognition unit 25 performs a banknote recognition by using the banknote recognition data elements that have been grouped in the step S105. The recognition unit 25 obtains a feature (size, image) of the banknote, and compares the feature with the respective denomination recognition data elements included in the grouped banknote recognition data elements.

When the banknote is any of the currency of the grouped banknote recognition data elements, the recognition unit 25 can recognize a denomination and so on of the banknote. On the other hand, when the banknote is not any of the currency of the grouped banknote recognition data elements, the recognition unit 25 cannot recognize the banknote.

For example, suppose that the banknote recognition data elements of dollar, yen and euro are grouped in the step S105, and that a banknote, which has been taken in by the reception unit 31 in the step S107, is a euro banknote. In this case, the recognition unit 25 can recognize the banknote. On the other hand, when a banknote, which has been taken in by the reception unit 31 in the step S107, is a pound banknote, the recognition unit 25 cannot recognize the banknote.

(Step S109)

The banknote, which has been recognized by the recognition unit 25 in the step S108, is stacked in the stacking unit 39, and a banknote which has not been recognized is stacked in the reject unit 38.

(Step S110)

When all the banknotes have been taken in, the program proceeds to a step S111. On the other hand, when there remains a banknote in the reception unit 31, the program returns to the step S107.

(Step S111)

A count result of the banknotes having been recognized by the recognition unit 25 is displayed on the display unit 36. For example, the display unit 36 displays the count result of the banknotes for each denomination. The count result to be displayed includes the number of banknotes for each denomination, the total number, the total sum and so on. Further, the number of banknotes which could not be counted by the recognition unit 52 may be displayed. The banknote counting operation may be performed by the recognition unit 25 or by the control unit 10.

In this embodiment, the banknote recognition data elements of a plurality of currencies designated by a user are grouped, and the recognition unit 25 can recognize banknotes of mixed currencies and denominations with the use of the grouped banknote recognition data elements. In addition, the banknotes are compared only with the denomination recognition data elements included in the banknote recognition data elements of the currencies designated by the user, and the banknotes are not compared with other denomination recognition data elements. Thus, lowering of a processing speed can be prevented. Further, since the number of denomination recognition data elements included in one group is not more than the predetermined upper limit, the number of denomination recognition data elements, which are used for comparison by the recognition unit 25 in the step S108, is not more than the predetermined upper limit. Thus, the processing speed can be maintained at a predetermined level or more.

As described above, this embodiment can deal currencies of a number of nations and can handle banknotes at a predetermined speed or more.

In the above embodiment, an upper limit of the number of denomination recognition data elements that can be included in one group, which serves as a predetermined criterion, may be a fixed value, or may be set based on a condition whether the number of currencies to be dealt is prioritized or the processing speed is prioritized. For example, the upper limit is set as 50 in a normal mode, the upper limit is set as 64 in a mode in which the number of dealt currencies is prioritized, and the upper limit is set as 30 in a mode in which the processing speed is prioritized. By designating one of the modes, the upper limit can be set.

Second Embodiment

In the above first embodiment, a user designates desired currencies, and the selection unit 70 groups the banknote recognition data elements corresponding to the currencies designated by the user, such that the number of denomination recognition data elements is not more than a predetermined upper limit. On the other hand, in this embodiment, there are prepared beforehand a plurality of groups of a plurality of banknote recognition data elements in which the total number of denomination recognition data elements is not more than a predetermined upper limit, and any one of the groups is selected. The structure of the banknote handling apparatus is the same as that of the first embodiment shown in FIGS. 1 and 2.

Figure 7:
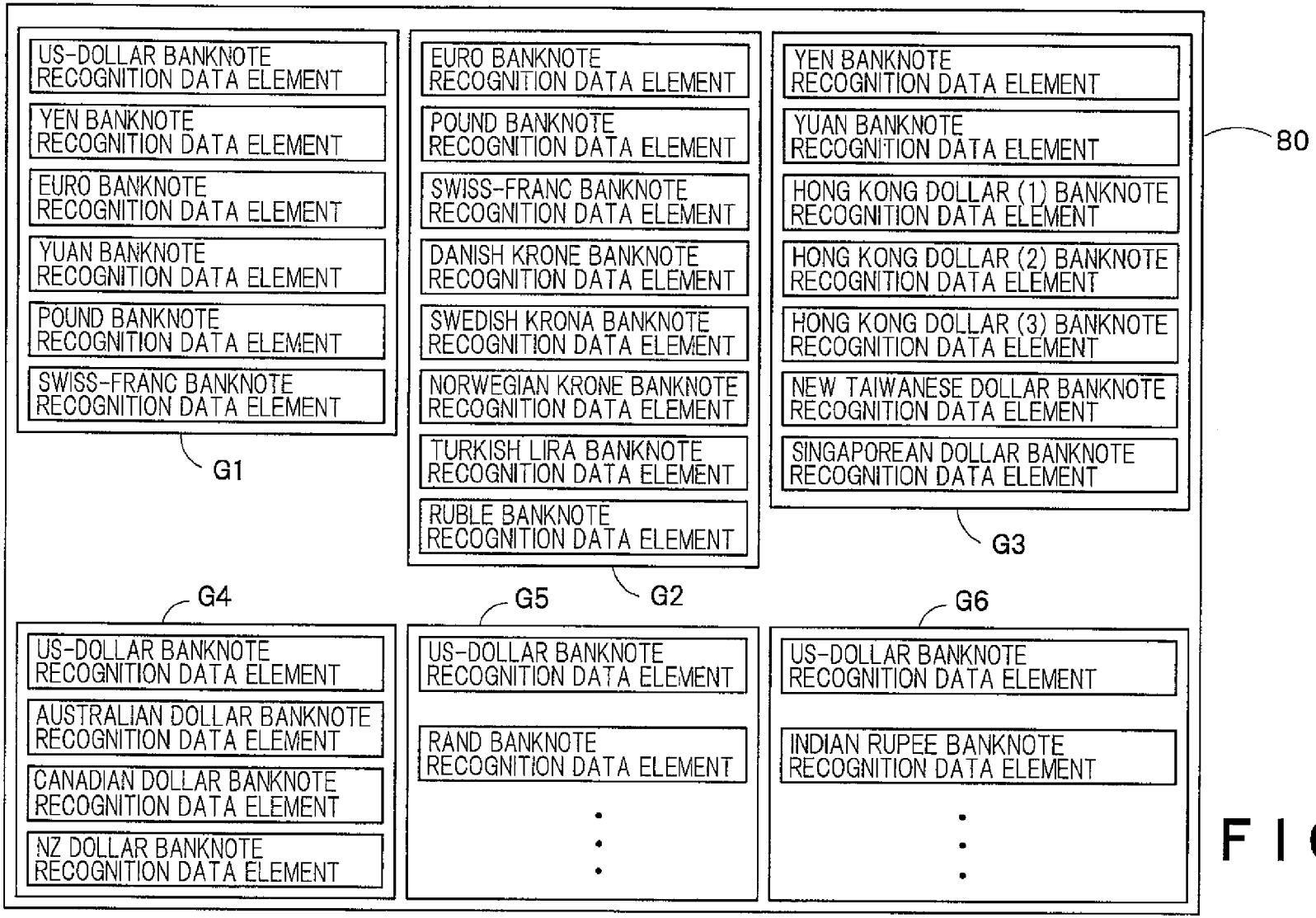
FIG. 7 is a view showing an example of grouped banknote recognition data elements.

In this embodiment, as shown in FIG. 7, for example, the memory unit 80 stores a plurality of groups G1 to G6 including a plurality of banknote recognition data elements corresponding to currencies of a plurality of nations. In FIG. 7, an upper limit of the number of denomination recognition data elements that can be included in one group is 50.

For example, the group G1 includes banknote recognition data elements of US dollar, yen, euro, yuan, pound and Swiss franc, and the total number of denomination recognition data elements is 34. In addition, the group G2 includes banknote recognition data elements of euro, pound, Swiss franc, Danish krone, Swedish krona, Norwegian krone, Turkish lira and ruble, and the total number of denomination recognition data elements is 44.

The operation unit 35 and the display unit 36 are constituted by the touch panel 40. The touch panel 40 displays the groups G1 to G6 as shown in FIG. 7. When a user presses a key corresponding to any one of the groups G1 to G6, the selection unit 70 selects the group designated by the user. The recognition unit 25 performs the banknote recognition operation by using the banknote recognition data elements included in the group selected by the selection unit 70.

Similarly to the above first embodiment, since the number of denomination recognition data elements included in each group is not more than the predetermined upper limit, the number of denomination recognition data elements, which are used for comparison by the recognition unit 25, is not more than the predetermined upper limit. Thus, lowering of the processing speed can be prevented.

As described above, this embodiment can deal currencies of a number of nations and can handle banknotes at a predetermined speed or more.

In the above second embodiment, after the selection of the group, a banknote recognition data element of another currency may be added to the selected group, or one of the banknote recognition data elements included in the selected group may be changed to a banknote recognition data element of another currency or deleted, as long as the number of denomination banknote recognition data elements is not more than the predetermined upper limit.

Since the banknote recognition data elements included in the selected group can be modified, requests of more user can be satisfied.

In the above second embodiment, two or more groups may be selected. Note that two or more groups can be selected as long as the number of denomination recognition data elements included in the plurality of selected groups is not more than the predetermined upper limit.

In the above first and second embodiments, when a time period required for comparing a banknote to be recognized with a banknote recognition data element of a first currency is longer than a time period required for comparing a banknote to be recognized with a banknote recognition data element of a second currency, a weight value may be set for the first currency. In this case, when the total number of denomination recognition data elements included in one group is calculated, the number of denomination recognition data elements of the first currency is weighted.

For example, since yen banknotes differ in size depending on denominations, a denomination can be specified by a banknote size. Thus, a time period required for comparison is short. On the other hand, since US dollar banknotes of respective denominations are the same in size, comparison with denomination recognition data elements of all the denominations is needed, which takes a long time period. Thus, a weighting coefficient value W (W>1) is set for the US dollar. For example, the total number of denomination recognition data elements of a group composed of banknote recognition data elements of US dollar, yen, euro, yuan, pound, Swiss franc is $7\times W+27$.

Due to such a weighting, grouping of banknote recognition data elements for handling banknotes can be more reliably performed at a predetermined speed or more.

In the above first and second embodiments, although an upper limit of the number of denomination recognition data elements that can be included in one group is used as a criterion for grouping banknote recognition data elements, an upper limit of a total data amount of the banknote recognition data elements that can be included in one group may be used. When the total data amount of the banknote recognition data elements to be used for comparison by the recognition unit 25 is not more than a predetermined upper limit, lowering of the processing speed can also be prevented.

In addition, as to a banknote recognition data element of each currency, when a time period required for the recognition unit 25 to compare one banknote is known, a criterion used when banknote recognition data elements are grouped may be an upper limit T of a time usable for recognizing one banknote. Namely, banknote recognition data elements are grouped such that a total time period required for the recognition unit 25 to compare one banknote is not more than the upper limit T.

Figure 8:
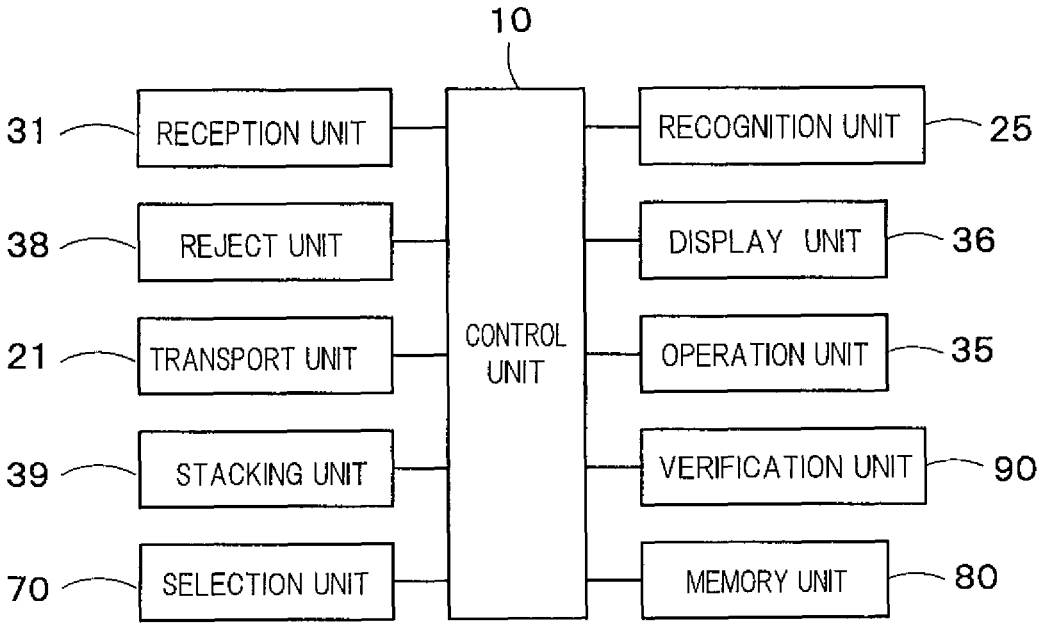
FIG. 8 is a block structural diagram of the banknote handling apparatus according to a modification example.

In addition, as shown in FIG. 8, a verification unit 90 configured to receive a verification instruction may be further provided. In this case, out of the banknote recognition data elements stored in the memory unit 80, selection of a banknote recognition data element subject to the verification instruction received by the verification unit 90 may be allowed. For example, upon shipment of the banknote handling apparatus, only a part of the banknote recognition data elements shown in Table 1 can be selected. When a user desires the use of a banknote recognition data element of another currency, the user pays a license fee corresponding to the currency to receive issuance of a verification code (e.g., password), and inputs the verification code to the banknote handling apparatus. Then, the verification unit 90 allows selection of the banknote recognition data element of the currency subject to the inputted verification code.

In the above first and second embodiments, there may be prepared, as to one currency, a banknote recognition data element corresponding to new version of banknotes, and a banknote recognition data element corresponding to old version of banknotes, respectively. In addition, when misprinted banknotes of a certain currency are circulated, a banknote recognition data element of the misprinted banknotes may be prepared.

In the above first and second embodiment, although the selection by the selection unit 70 is performed in terms of a currency unit (banknote recognition data element unit), the selection may be performed in terms of a denomination unit (denomination recognition data element unit). For example, when banknote recognition data are grouped, denomination recognition data elements of 1000 yen, 5000 yen and 10000 yen are selected, and a denomination recognition data element of 2000 yen is not selected. In this case, after banknotes have been handled, a 1000-yen banknote, a 5000-yen banknote and a 10000-yen banknotes are staked in the stacking unit 39, while a 2000-yen banknote is staked in the reject unit 38.

The present invention is not limited directly to the above embodiments, and the present invention can be carried out by modifying the constituent elements within a scope not departing from the scope of the present invention. In addition, by suitably combining the plurality of constituent elements disclosed in the above embodiments, various invention can be formed. For example, some constituent elements may be deleted from all the constituent elements shown in the embodiments. Moreover, constituent elements used in the different embodiments may be suitably combined.

1 Housing
10 Control unit
21 Transport unit
25 Recognition unit
31 Reception unit
35 Operation unit
36 Display unit
38 Reject unit
39 Stacking unit
70 Selection unit
80 Memory unit
90 Verification unit

The invention claimed is:

1. A banknote handling apparatus comprising:

a reception unit configured to take in, one by one, a banknote put thereinto;

a transport unit configured to transport the taken-in banknote;

a memory unit storing a plurality of banknote recognition data elements corresponding to currencies of a plurality of nations;

a grouping unit configured to group, as one group, the banknote recognition data elements for different currencies, said banknote recognition data elements for different currencies being selected so as to meet a predetermined criterion; and a recognition unit configured to recognize the banknote taken in by the reception unit, based on the grouped banknote recognition data elements.

2. The banknote handling apparatus according to claim 1, wherein each banknote recognition data element includes a plurality of denomination recognition data elements; and the predetermined criterion is a criterion related to the number of the denomination recognition data elements included in one group.

3. The banknote handling apparatus according to claim 2, wherein the number of the denomination recognition data elements is weighted by a weighting coefficient value set for each currency.

4. The banknote handling apparatus according to claim 1, wherein the predetermined criterion is a criterion related to a total data amount of the banknote recognition data elements included in one group.

5. The banknote handling apparatus according to claim 1, wherein the predetermined criterion is a criterion related to a time period required for recognizing each banknote, when the recognition unit recognizes a banknote based on the grouped banknote recognition data elements.

6. The banknote handling apparatus according to claim 1, further comprising a verification unit configured to permit, upon receipt of a verification instruction, the banknote recognition data element of a currency subject to the verification instruction to be selected.

7. The banknote handling apparatus according to claim 1, wherein the memory unit stores the banknote recognition data element corresponding to new version of banknotes, and the banknote recognition data element corresponding to old version of banknotes.

8. The banknote handling apparatus according to claim 1 further comprising a display unit, wherein the recognition unit is configured to recognize and count a banknote; and the display unit is configured to display a count result of the recognition unit for each currency.

9. A banknote handling apparatus comprising:

a reception unit configured to take in, one by one, a banknote put thereinto;

a transport unit configured to transport the taken-in banknote;

a memory unit storing a plurality of groups, each of which includes a plurality of banknote recognition data elements for different currencies, said banknote recognition data elements for different currencies being grouped as one group in advance so as to meet a predetermined criterion;

a recognition unit configured to recognize the banknote taken in by the reception unit, based on the grouped banknote recognition data elements for different currencies.

10. The banknote handling apparatus according to claim 9, wherein each banknote recognition data element includes a plurality of denomination recognition data elements; and the groups are set such that the number of the denomination recognition data elements included in each group meets a predetermined criterion.

11. The banknote handling apparatus according to claim 10, wherein the number of the denomination recognition data elements is weighted by a weighting coefficient value set for each currency.

12. The banknote handling apparatus according to claim 9, wherein the groups are set such that a time period required for the recognition unit to recognize each banknote, based on the banknote recognition data elements included in one group grouped by the grouping unit, meets a predetermined criterion.

13. The banknote handling apparatus according to claim 9, wherein each banknote recognition data element includes a plurality of denomination recognition data elements; and the grouping unit is configured to add, to the group being stored in the memory unit, a banknote recognition data element not included in said group, such that the number of the denomination recognition data elements included in said group does not exceed a predetermined value.

14. The banknote handling apparatus according to claim 9, further comprising a verification unit configured to permit, upon receipt of a verification instruction, the banknote recognition data element of a currency subject to the verification instruction to be selected.

15. The banknote handling apparatus according to claim 9, wherein the memory unit stores the banknote recognition data element corresponding to new version of banknotes, and the banknote recognition data element corresponding to old version of banknotes.

16. The banknote handling apparatus according to claim 9 further comprising a display unit, wherein the recognition unit is configured to recognize and count a banknote; and the display unit is configured to display a count result of the recognition unit for each currency.

17. The banknote handling apparatus according to claim 9, wherein the groups are set such that a total data amount of the banknote recognition data elements included in each group meets a predetermined criterion.

18. A banknote handling method comprising:

grouping, as one group, a plurality of banknote recognition data elements for different currencies, said banknote recognition data elements for different currencies being selected so as to meet a predetermined criterion;

taking in, by a reception unit, a banknote put thereinto, one by one; and recognizing, by a recognition unit, the banknote taken in by the reception unit, based on the grouped banknote recognition data elements.

19. A banknote handling method comprising:

taking in, by a reception unit, a banknote put thereinto, one by one; and recognizing, by a recognition unit, the banknote taken in by the reception unit, based on a plurality of banknote recognition data elements for different currencies, said banknote recognition data elements for different currencies being grouped as one group in advance so as to meet a predetermined criterion.

* * * * *